US006421967B1

(12) United States Patent
Wlaker

(10) Patent No.: US 6,421,967 B1
(45) Date of Patent: Jul. 23, 2002

(54) SPACE ENCLOSURE

(76) Inventor: John D. Wlaker, 507 E. 10th St., Duluth, MN (US) 55805

( * ) Notice: Subject to any disclaimer, the term of this patent is extended or adjusted under 35 U.S.C. 154(b) by 0 days.

(21) Appl. No.: 09/430,599

(22) Filed: Oct. 29, 1999

(51) Int. Cl.[7] ..... E04B 7/00
(52) U.S. Cl. ..... 52/198; 52/11
(58) Field of Search ..... 52/407.3, 302.3, 52/302.1, 11, 13, 14, 198

(56) References Cited

U.S. PATENT DOCUMENTS 2,289,469 A * 7/1942 Turner ..... 52/407.3 X
3,417,519 A * 12/1968 Hitter ..... 52/11
3,864,882 A * 2/1975 Lasscock ..... 52/11
4,860,502 A * 8/1989 Mickelsen ..... 52/11
5,010,696 A * 4/1991 Knittel ..... 52/11 X
5,511,351 A * 4/1996 Moore ..... 52/302.1
5,960,591 A * 10/1999 Schulter ..... 52/11
6,164,019 A * 12/2000 Salley ..... 52/11

* cited by examiner

*Primary Examiner*—Peter M. Cuomo
*Assistant Examiner*—Stephen Vu
(74) *Attorney, Agent, or Firm*—Angenehm Law Firm; N. Paul Friederichs; William Flynn

(57) ABSTRACT

A space enclosure having hangers and pans for enclosing the open spaces between each pair of adjacent joists. Hangers are attached on each side of the joist space and a pan is placed therebetween providing a continuous top over the area below the deck which allows the storage of water sensitive items in this area. The space enclosure may include a two part hanger with one part securable to the joist and the second part securable to the pan. The first hanger part is selectively securable to the second hanger part. The first hanger part may include mechanism for selectively detaching the first and second hanger parts. The second hanger part may include mechanism for stabilizing the system in high winds. The pan may include mechanism for cutting the pan for width adjustment and mechanism for fine tuned width adjustment. The enclosure may further include a bonnet for precipitation control.

17 Claims, 7 Drawing Sheets

SPACE ENCLOSURE

FIELD OF THE INVENTION

The present invention relates to methods and apparatus for enclosing the space between two parallel supports, such as between two adjacent joists in standard frame construction and more particularly to a plurality of hangers and a pan for enclosing each space between the pairs of adjacent joists whether the joists are parallel or non-parallel. The present application claims priority from application Ser. No. 60/106173 filed Oct. 29, 1998 and application Ser. No. 60/131,400 filed Apr. 28, 1999.

BACKGROUND OF THE INVENTION

In the conventional construction of wood frame buildings, the floors are supported by an array of parallel framing joists in a spaced apart relationship. Conventionally, these joists are constructed of dimensioned lumber, that is, lumber that is nominally two inches thick and an even number, such as eight, ten, or twelve, inches wide and having a length sufficient to span the area to be filled. However, it is presently becoming more common to engineer joists from other materials, such as open trusses, I-joists, glued laminates, and metal. The joists are placed having their longer dimension in a vertical plane and are separated by a fixed distance, typically sixteen, 19.2 or twenty-four inches. The spacing is center of the top face of two adjacent joists and is expressed as sixteen, 19.2, or twenty-four inches on center.

In interior construction the joists form the base for an interior floor and are typically covered with four foot by eight foot sheets of plywood or oriented strand board forming a continuous top surface while leaving rectangular open spaces below, between each pair of adjacent joists. Frequently, the lower surface of the joists is covered becoming the ceiling of the rooms below.

In exterior construction, such as a deck, the joists are covered with spaced apart planking. The planking is fastened to the joists having a small space between any two planks for esthetic considerations, and more importantly, to allow the planking to shed rain water. When the deck is constructed a distance above grade, this leaves an open area below the deck which could be used for storage, were the area not open the rain and other elements.

SUMMARY OF THE INVENTION

The invention disclosed herein is hangers and pans for enclosing the open spaces between each pair of adjacent joists. Hangers are attached on each side of the joist space and a pan is placed therebetween providing a continuous top over the area below the deck which allows the storage of water sensitive items in this area.

The improved preferred embodiment of the present invention includes a two part hanger with one part securable to the joist and the second part securable to the pan. The first hanger part is selectively securable to the second hanger part. The first hanger part may include mechanism for selectively detaching the first and second hanger parts. The second hanger part may include mechanism for stabilizing the system in high winds. The pan may include mechanism for cutting the pan for width adjustment and mechanism for fine tuned width adjustment.

DETAILED DESCRIPTION OF THE INVENTION

Figure 1:
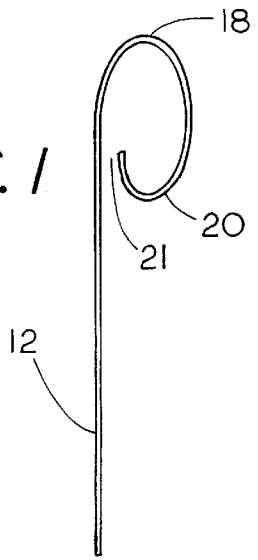
FIG. 1 is a cross-sectional view of an embodiment of the hanger.
Figure 2:
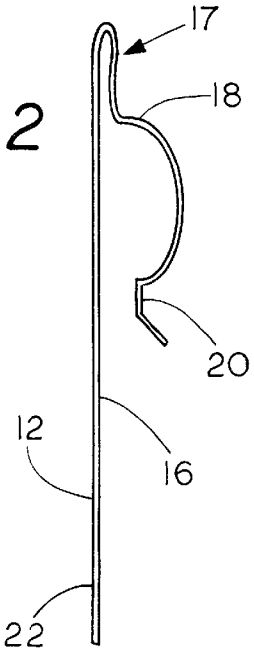
FIG. 2 is a cross-sectional view of the preferred embodiment of the hanger.

The present invention, generally 10, as shown in FIGS. 1–5 consists of a plurality of hangers 12 and a pan 14. The hangers 12 may be formed from a thin material in the cross-sectional shape similar to the letter capital "R". Each hanger 12 has an attachment tail 16, an upper loop 18, and a formed retainer 20. The upper loop 18 may have a fastening lip 17, shown in FIG. 2, with such fastening lip 17 providing a place for a nail, screw, or other fastener. The pan 14 is likewise formed from a sheet of thin material. The pan 14 on its each side has formed an elongate rounded holder 30 formed along the periphery of each side. The holder 30 is designed to removably mate with the retainer 20 of the hanger 12. The pan 14 further may have at least one ridge 32 formed along its length substantially parallel to the holders 30. The ridge 32 may be pointed, flat (as shown), rounded, or other suitable shape. Parallel to the at least one ridge 32 there is formed a plurality of valleys 34.

Figure 6:
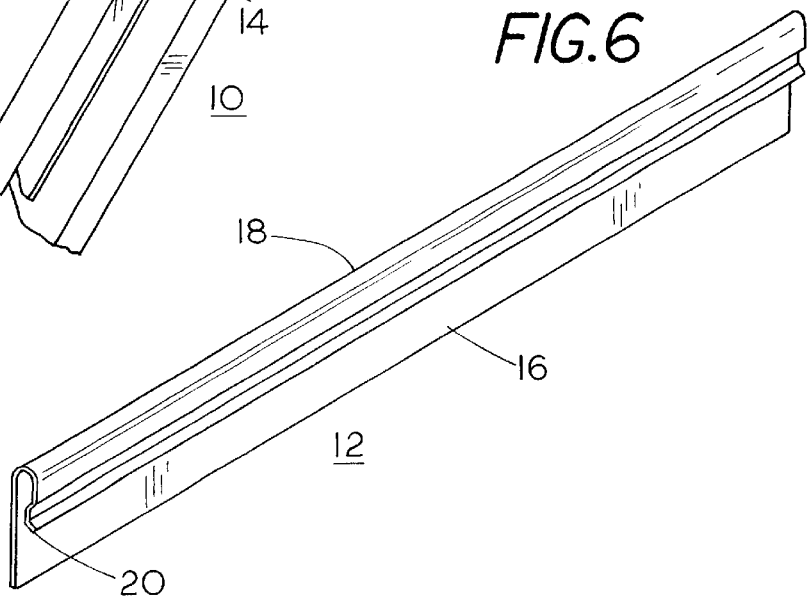
FIG. 6 is an isometric view of the preferred embodiment of an elongate hanger.

The hanger 12 may be formed from any material such as metal, elastomeric sheeting, canvas, plastic, including vinyls, or other materials suitable for the conditions described herein. The hanger 12 may be a continuous length of hanger 12, as shown in FIG. 6, or may be multiple short hangers 12 arrayed along a joist 40. Each hanger 12 is attached to a joist 40 by any suitable means, including discrete fasteners such as nails, screws, or staples, or adhesive. In one embodiment of the invention the back side 22 of the hanger 12 is coated with a pressure sensitive adhesive so that the hanger 12 may be placed against and adhered to a joist 40 with or without the use of additional fasteners.

Figure 4:
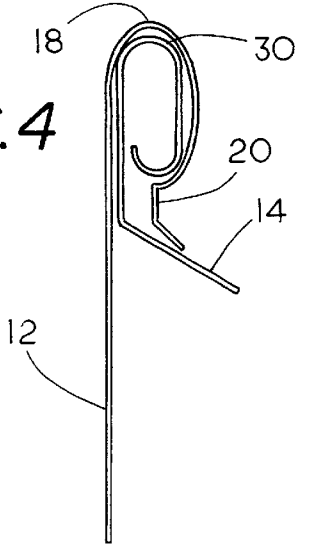
FIG. 4 is a partial cross-sectional view showing the pan installed in the preferred embodiment of the hanger.

The material forming the hanger 12 must have sufficient resistance to bending so that when the holder 30 of the pan 14 has been placed into the retainer 20 of the hanger 12 the holder 30 of the pan 14 will not be inadvertently dislodged, yet, the material must be sufficiently flexible to allow a user to secure the pan 14 by placing its respective holders 30 into the hanger 12 retainers 20 without undue effort, as shown in FIG. 4.

Figure 31:
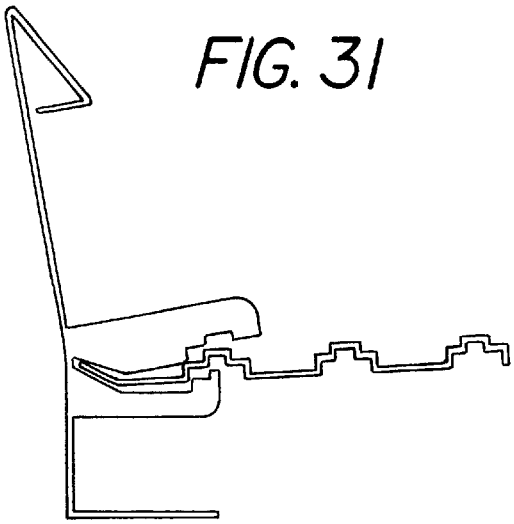
FIGS. 31 and 32 show an alternate embodiment the pan attaching horizontally to the hanger.
Figure 32:
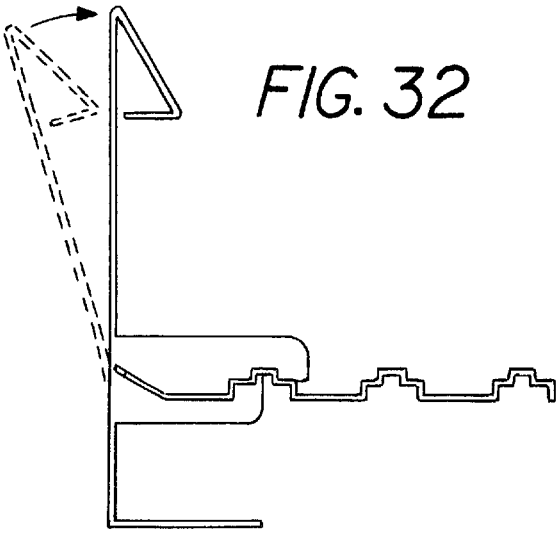

In another embodiment of the hanger 12 is shown in FIG. 1. In this embodiment, the hanger retainer 21 is curved spirally inward. Thus, when the pan holder 30 of a pan 14 is urged into the hanger loop 18, the hanger retainer wraps around the pan holder 30 securing the pan holder 30 more securely than when using the preferred embodiment of the hanger 12. This embodiment of the hanger 12 is used to more permanently secure the pan 14 to the hangers 12. The pan 14 may attach horizontally to the hanger 12 as shown in FIGS. 31 and 32, which in the bent position may allow easier insertion of the pan 14 and in the straight position, FIG. 32, may lock the pan 14 to the hanger 12.

The pan 14 may be formed from any material such as metal, canvas or plastic. The material used to form the pan 14 must be sufficiently stiff to support the anticipated loads placed upon it, yet sufficiently flexible so the material to cooperatively deform to allow the insertion of the holders 30 into the retainers 20 of the hangers 12. Each pan 14 is constructed having a proper width to fit between a pair of joists 40. That is, the width, as measured between the outer surfaces of the hangers 30 of the pan 14 would be approximately 14.5 inches to fit sixteen inch on center joists or 22.5 inches to fit twenty-four inch on center joists 40. Variations in the width between the joists will be accommodated by the flexibility of the pan 14, which includes radial joists as used in circular shaped decks. The pan 14 can also be fabricated in different widths for other applications. The pan 14 may be fabricated in any convenient lengths such as eight to twenty feet.

Figure 3:
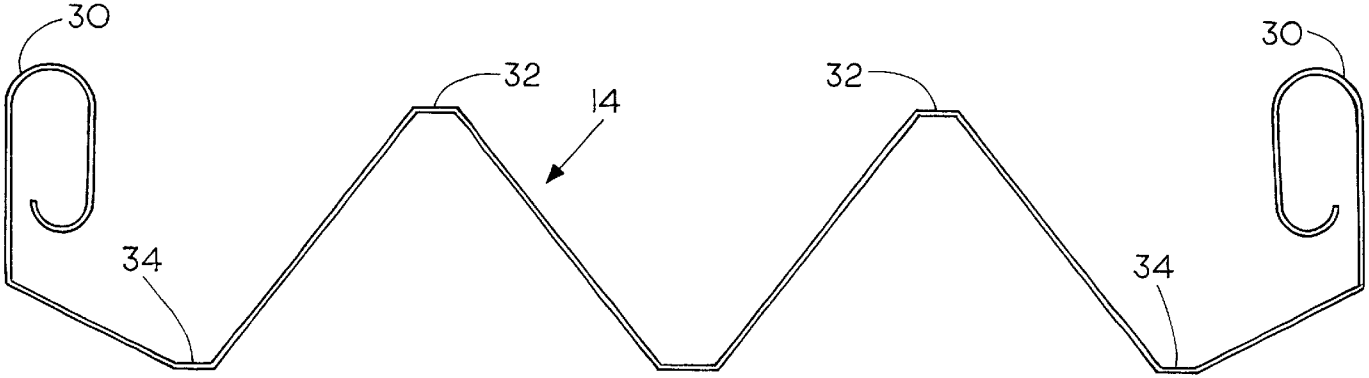
FIG. 3 is a cross-sectional view of the preferred embodiment of the pan to be inserted into a hanger.

The cross-sectional view of the pan 14, as shown in FIG. 3, shows longitudinal ridges 32 and valleys 34 which are provided for the purpose of stiffening the pan 14 alone its length and reducing the movement of water on the pan 14 and ice damage. It is understood that the ridges 32 and valleys 34, if present, need not be of any particular number or shape, but should provide the necessary stiffening and slosh reduction.

Figure 5:
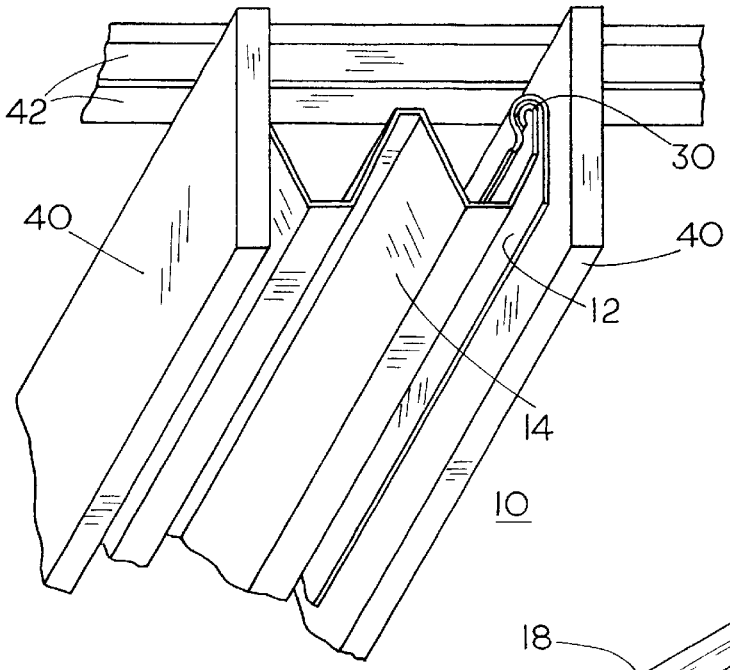
FIG. 5 is an isometric view looking upwards showing the invention installed between a pair of adjacent joists.

In its use, the user selects sufficient lengths of pans 14 and sufficient number of hangers 12 for the application. The hangers 12 are then attached to the sides of the joists 40, as shown in FIG. 5. The hangers 12 are located vertically off horizontal so as to provide a slight slope to allow the rainwater to drain to one end, When an appropriate number of hangers 12 have been attached to a pair of adjacent joists 40, one or more sections of pan 14 may be inserted therebetween. Each length of pan 14 is inserted by placing the pan holders 30 abutting the hanger retainers 20 and urging the pan holders 30 into the hanger retainers 20 by deforming both the hanger retainers 20 and the pan holders 30. When so installed, as shown in cross-section in FIG. 4, the pan 14 is retained and provides a water repellent layer for protecting the goods stored below.

When so installed, rain falling upon the deck boards 42 will pass through the spaces between the deck boards 42 and fall onto the pan 14. The ridges 32 in the pan 14, if present, may limit the lateral movement of the water directing the water to the valleys 34, where the water will flow down the slope of the pan 14 to its end and thence off of the pan 14 into a collection area. Thus, anything stored beneath the deck boards 42 is protected from rain and other precipitation.

Figure 7:
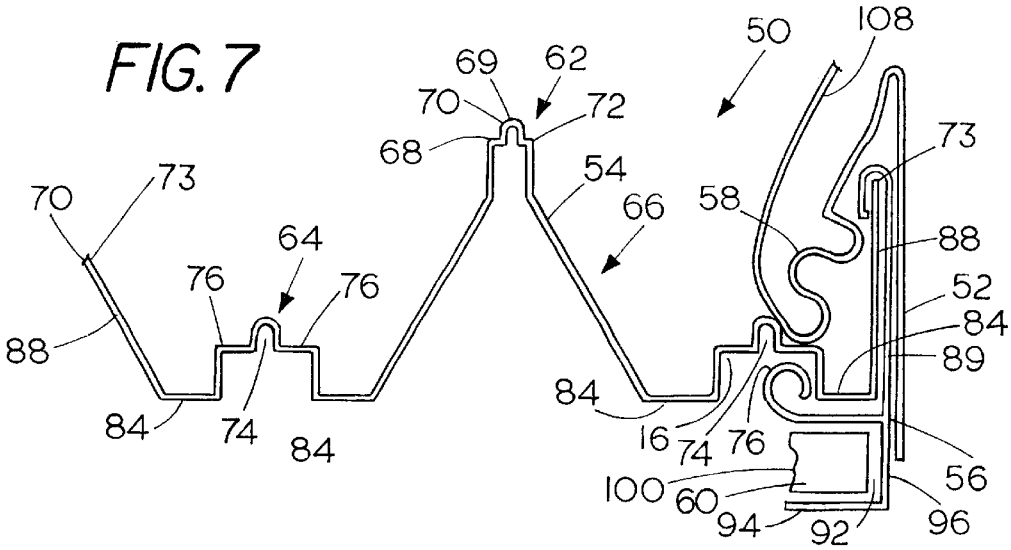
FIG. 7 is a sectional view of the improved preferred embodiment of the pan secured to the second hanger portion inserted into the first hanger portion together with the selective detachment mechanism.
Figure 8:
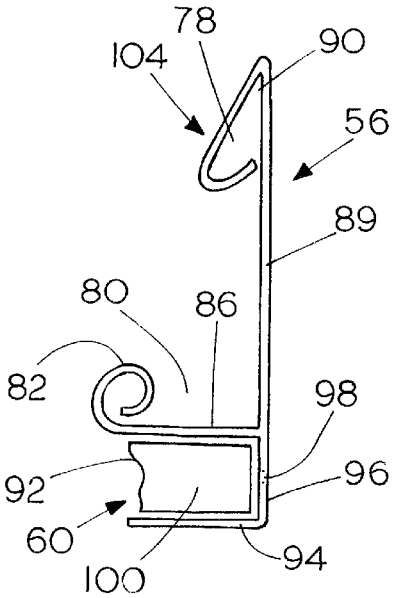
FIG. 8 is an end view of the second hanger portion with a portion of a stabilizing bar.
Figure 9:
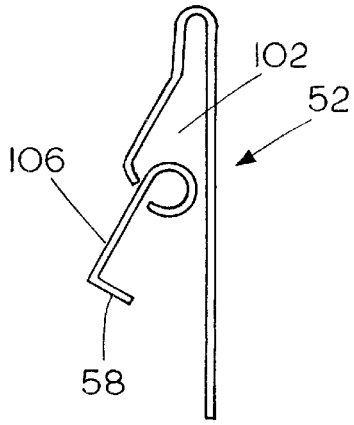
FIG. 9 is an end view of the first hanger portion.

The inventor has further designed an improved preferred embodiment 50 shown in FIGS. 7–9. The improved preferred embodiment of the present invention includes a two part hanger with one part 52 securable to the joist 40 and the second part securable to the pan 54. The first hanger part 52 may include mechanism 58 for selectively detaching the first and second hanger parts 52, 56. The second hanger part 52 may include mechanism 60 for stabilizing the system in high winds. The pan 54 may include mechanism 62 for cutting the pan 54 for width adjustment and mechanism 64 for fine tuned width adjustment. These aspects are further defined below.

The pan 54 may include a primary ridge 66, having a secondary ridge 68 with a bead 69 defined at the top thereof Together the primary and secondary ridges 66, 68 with bead 69 may define the mechanism 62 for cutting the pan 54 for width adjustment. The primary ridge 66 has the basic functions as the ridge 32 described in the other drawings. The bead 69 provides an easy to identify area to score and break the pan 54 to the desired width. The user simply uses a knife or other such object and scores the pan 54 along the bead 69 and folds the pan 54 along the score mark 70 to break the pan 54 in a desired location, This function could be achieved without the secondary ridge 68 or bead 69, although the secondary ridge 68 or bead 69 provides the added aspect of helping control the location of the knife along or near the peak 72 of the primary ridge 66. Once cut, the each edge 73 or the pan 54 is sized and shaped to be joined with the second hanger portion 56.

The pan 54 may further include a mechanism 64 for fine tuned width adjustment. The fine tune mechanism 64 may include a finger port 74 and shoulders 76. The finger port is sized to generally receive a finger of the user. Two or more finger ports 76 are positioned between each of the primary ridges 66, although this is not necessary. The shoulders 76 provide a slightly wider opening for the user's finger and, as will be later discussed, create a point of attachment for the second hanger portion 52. Subject to these aspects the pan is intended to be made in the same mode, manner, materials and have the same function as the pan 14 as described with respect to the other drawings.

The second hanger portions 56 may be Generally shaped as shown in FIG. 8. The second hanger portion 56 may include an upper pocket 78 for retaining the edge 73 of the pan 54 and a lower pocket 80 for biasing against the shoulder 76 immediately adjacent the edge 73 of the pan 54. The edge 73 is slipped into the upper pocket 78 for retainment therein. The lower pocket 80 may include a projection 82, shown curled, that fits in the shoulder 76 of the pan 54 as shown in FIG. 7. The horizontal segment 84 immediately adjacent the shoulder 76 is intended to be shorter, but approximately the same length as the upper horizontal segment 86 of the second hanger portion 56, thereby securing the pan 54 horizontally with respect to the second hanger portion 56. This vertical end segment 88 or the pan 54 to position relatively parallel with the vertical wall 89 or the second hanger portion 56. The vertical end segment 88 of the pan 54 is intended to be shorter, but approximately the same length, between the upper horizontal segment 86 or the second hanger portion 56 and the upper point 90 of the upper pocket 78. This provides for vertical securement of the pan 54 relative to the second hanger 56. The securement points between the pan 54 and the second hanger portion 56 may be selective, permanent, or integral, although the securement points are intended to be selective.

The secondary hanger 56 may include mechanism 60 for stabilizing the system in high winds. Such stabilizing mechanism 60 may include stabilizing bar 100 and a pocket 92 defined between the upper horizontal segment 86 and a lower horizontal segment 94, which are positioned relative to one another with the pocket vertical wall 96. The stabilizing bar 100 is intended to be oriented perpendicularly to the secondary hanging portion 56, spanning the width of the pan 54 to the opposing pocket 92. The pocket vertical wall 96 may include openings or a continuous indentation 98 guiding fasteners to the joist 40. A bead or continuous opening may also be provided on the first hanger 52 such as was shown and described with respect to the embodiments shown in FIGS. 1–6. The pocket 92 further provides an area in which a stabilizing bar 100 may be glued or otherwise secured into the pocket 92 perhaps with fasteners projecting through openings 98 into the stabilizing bar 100. The stabilizing bar is intended to hold the system more rigid in high wind encounters and add support to prevent ice damage. FIGS. 27–30 show alternate embodiments of the stabilizing mechanism 60, including stabilizing bars 100 and pockets 92 together with nubs 101 sized and positioned to snugly fit the circumference of the bars 100.

The first hanger 52 secures to a joist 40 in a manner similar to that shown and described with regard to hanger 12 shown and described in FIGS. 1–6. The first hanger portion 52 includes a pocket 102 for retaining the head 104 of the second hanger portion 56. The head 104 is slipped into the pocket 102 and is selectively held therein.

The first hanger portion 52 may further include mechanism 58 for selectively detaching the first and second hanger parts 52, 58. On occasion a user may wish to remove the pan 54 for cleaning, replacement, or other purpose. The detaching mechanism 58 permits this to be done, while allowing the first and second hanger portions 52, 56 to remain more solidly secured at all other times. Specifically, the detaching mechanism. May include a hook 106. The hook 106 may be captured from above with a tool 108, FIG. 7, perhaps through slits between boards on the upper surface of a deck. The tool 108 may be a loop, relatively ridged hook, or other suitable design for selectively capturing and biasing against the hook 106, of the first hanger portion 52. When the tool 108 biases against the hook 106, the pocket 102 is spread allowing the head 104 out of the pocket 102.

In use, the installer secures the first hanger portion 52 to a joist 40. This securement may be selective, permanent, or integral. The pan 54 may be sized via scoring and bending, perhaps by the user or manufacturer, and is joined to the second hanger portion 56 as described above. The head 104 of the second hanger 56 is inserted into the first hanger portion 52 for retainment therein. This is performed on each side of the pan 54 such that the pan 54 is secured between the joists 40. The user may then adjust the width, wider, or narrower, of the pan 54 for an even and smooth appearance using finger ports 74. To remove the pan 54 the user may use tool 108 to capture the hook 106, reaching down from above the pan 54. The tool 108 is biased against the hook 106 to open the pocket 102 and allow the head 104 to escape the pocket 102.

Figure 10:
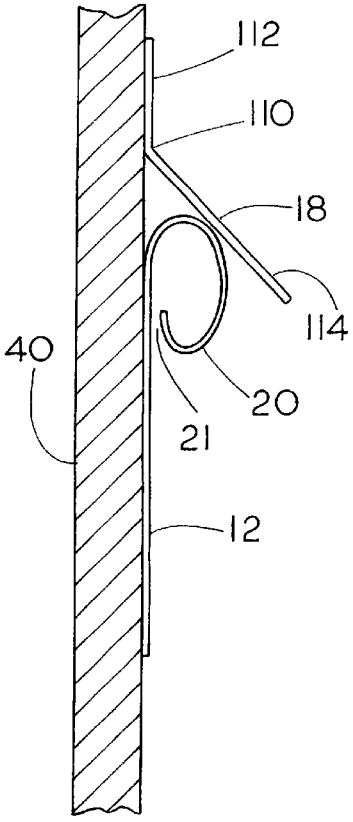
FIG. 10 is a cross-sectional view of an embodiment of the hanger in the third embodiment of the invention.
Figure 11:
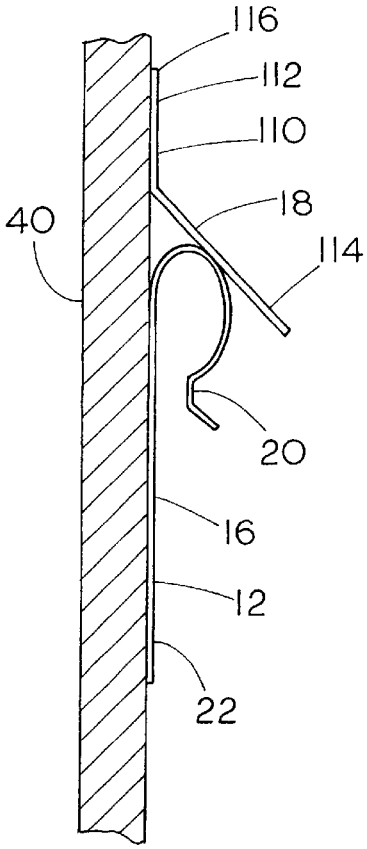
FIG. 11 is a cross-sectional view of the preferred embodiment of the hanger in the third embodiment of the invention.
Figure 12:
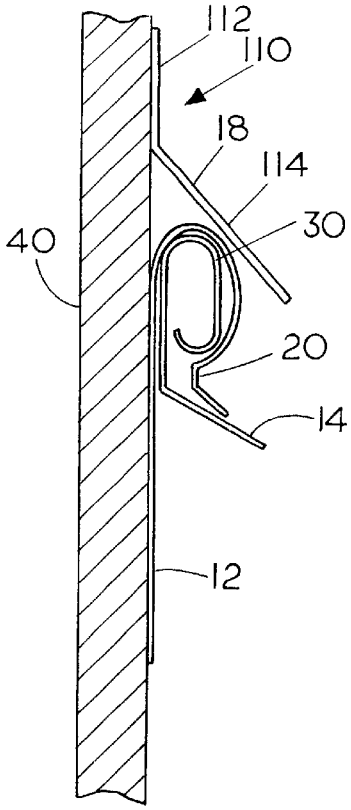
FIG. 12 is a partial cross-sectional view showing the pan installed in a preferred embodiment of the hanger in the third embodiment of the invention.
Figure 26:
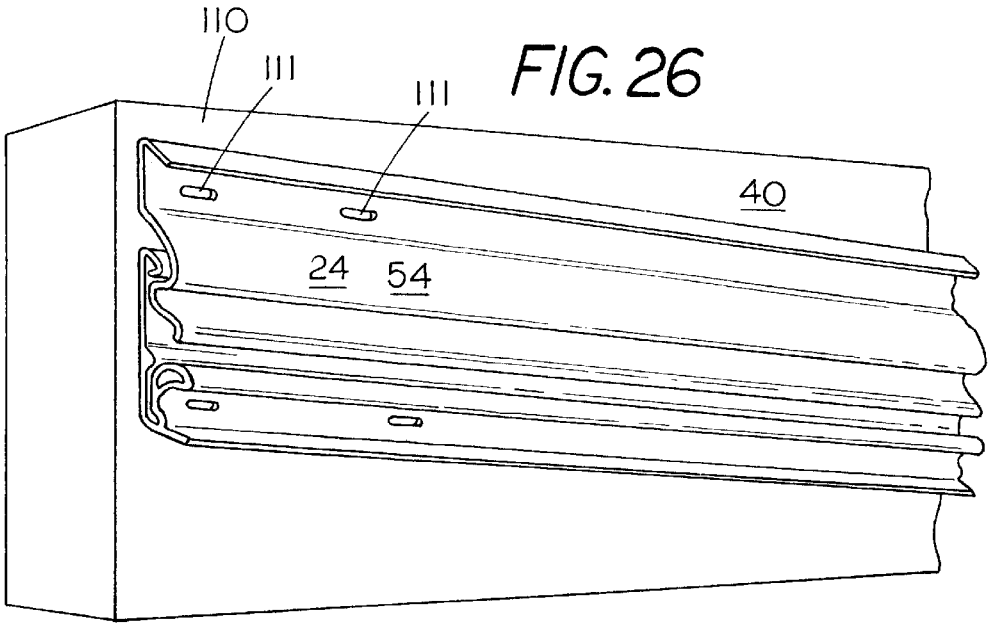
FIG. 26 shows an alternate embodiment of the bonnet and fastener as being integral.
Figure 27:
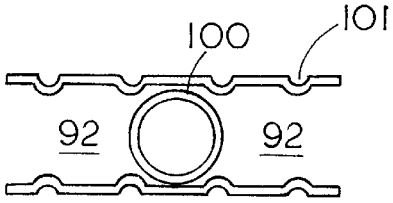
FIGS. 27–30 alternate embodiments of stabilizer bars.
Figure 28:
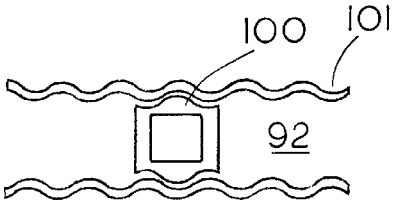
Figure 29:
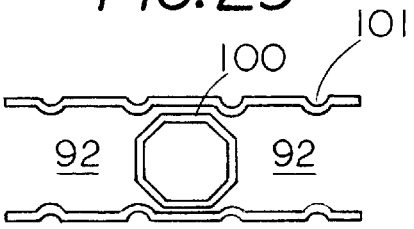
Figure 30:
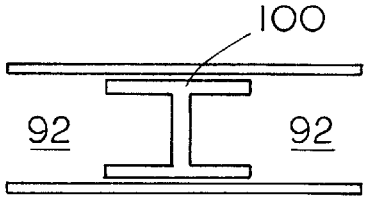

In a third embodiment of the invention, as shown in FIG. 10–12, the previously discussed hangers 12, or 54 are used with a pan 14 or 54 with the addition of a bonnet 110 above the hangers 12 or 54. The bonnet 110 and hangers 12 or 54 may also be integral as shown in FIG. 26 with fastener openings 111. The bonnet 110 provides a mounting flange 112 and an angular lip 114. The mounting flange provides for the attachment of the bonnet 110 to a joist 40. The angular lip 114 functions to direct the rainwater or the like away from the joist 40 and into the pan 14, 54 for disposal. The flange 112 may be mounted to the joist 40 by any suitable means such as nails, screws, or other discrete fasteners and is preferably attached using a continuous strip of adhesive to prevent the intrusion of water between the flange 112 and the joist 40. When the bonnet 110 is attached to a joist 40 using discrete fasteners, it is preferred that the bonnet 110 is additionally sealed to the joist 40 using a bead of caulk or other sealant 116, as shown in FIG. 11.

The angular lip 114 of the bonnet 110 is located in a downwardly facing acute angle to the joist 40. The lip 114 collects water and directs the water away from the joist and into the pan 14, or 54 preventing water from collecting between the joist 40 and a hanger 12 or 52 where the water can cause the deterioration of the joist 40 or leak past the hanger 12 or 54 and damage any goods stored below.

While the bonnet 110 has been shown as a separate piece from the hanger 12 or 52, it is understood that in some embodiments of the space encloser 10, it is preferred that the bonnet 110 be formed integral with the hanger 12 or 54. It is further understood that the bonnet 110 may be added to either of the two previously described embodiments of the space encloser 10.

In its use, the third embodiment of the space encloser 10 is quite similar to the above descriptions made with respect to the previous embodiments. Particularly, when the bonnet 110 is constructed integral with a hanger 12, 52 the operation is identical to the previous description of the embodiments of the space encloser 10. In some cases, however, it may be advantageous to add a bead of caulk or sealant 116 over the bonnet to provide additional sealing.

When a discrete bonnet 110 is used, the bonnet 110 must be added before the space is completely enclosed by the space encloser 10, and can be added at any step therebefore. For example, the bonnet 110 may be added before or after the hangers 12, 52 are installed.

Figure 14:
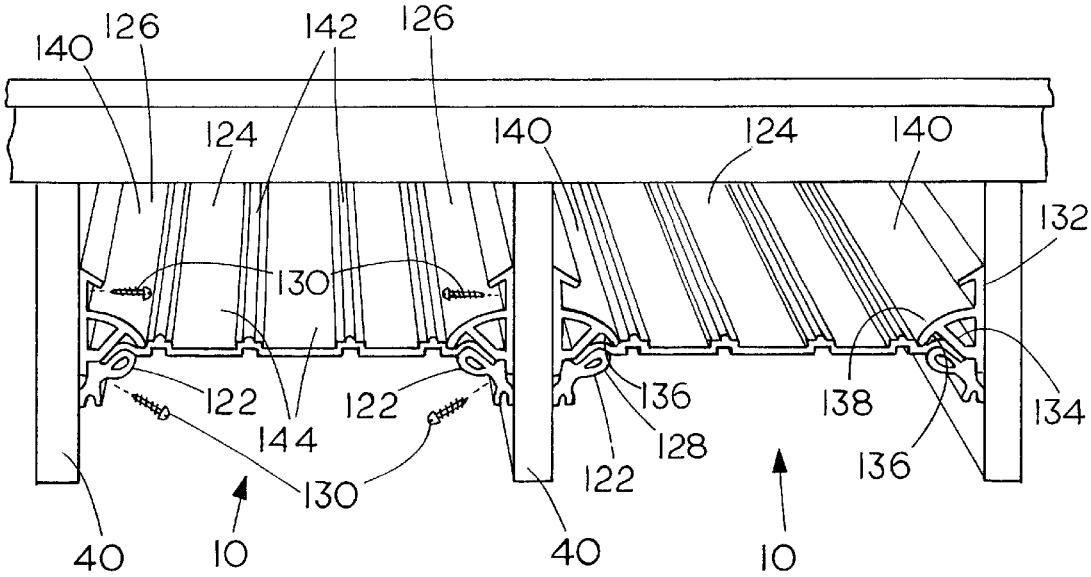
FIG. 14 is an isometric view of the fourth embodiment of the intention.
Figure 15:
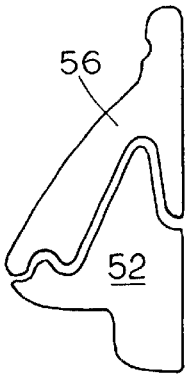
FIGS. 15–25 are cross sectional views of additional alternate embodiments of the hangers.
Figure 16:
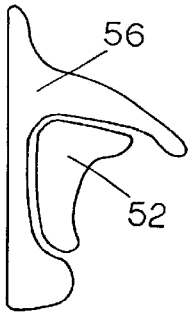
Figure 17:
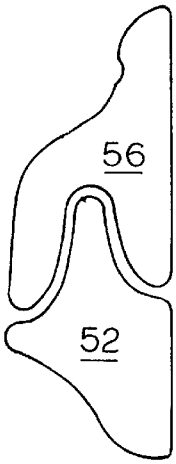
Figure 18:
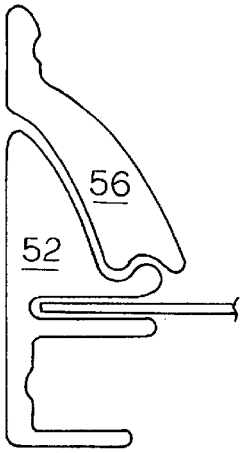
Figure 19:
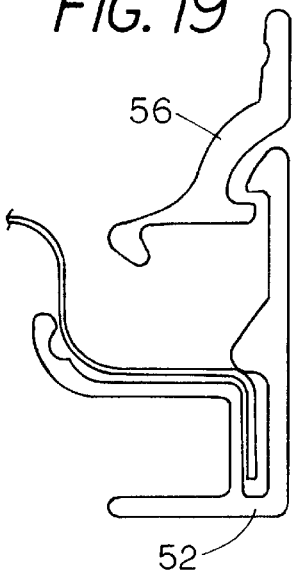
Figure 20:
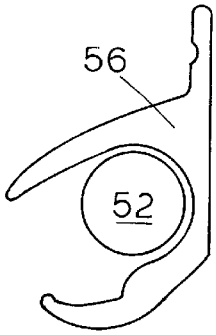
Figure 21:
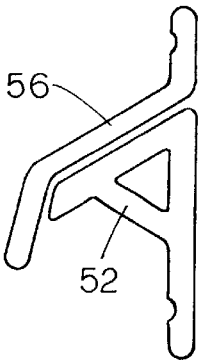
Figure 22:
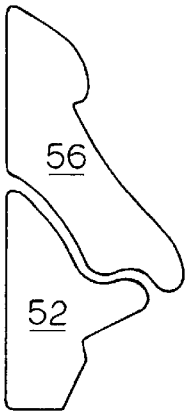
Figure 23:
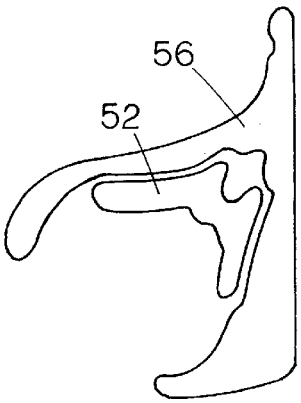
Figure 24:
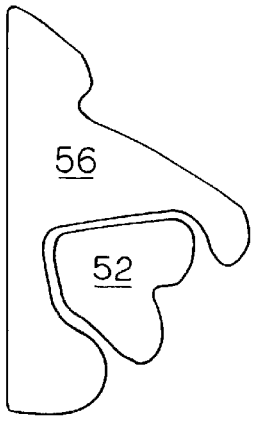
Figure 25:
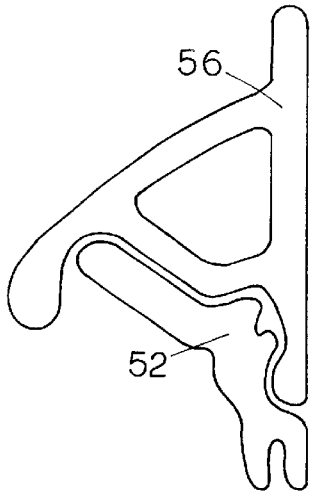

In a fourth embodiment of the space encloser 10, as shown in FIG. 14, the hangers first parts 122 are located longitudinally along the joists 40 as described and discussed the previous three embodiments. The pan 124 is located longitudinally between the joists 40 enclosing the space therein while being secured to the hanger second parts 126. The hanger first part 122 is elongate and formed from one of the suitable materials described above. The hanger first part 122 is attached to the joists 40 using either discrete fasteners 130 or an adhesive. The discrete fasteners shown in FIG. 14 are shown as screws for convenience, it being understood that the discrete fasteners 130 may also be nails, staples, or the like. The hangers first part 122 have an upturned lip 128 extending outwardly from the joist 40 for mating with the hanger second part.

The hanger second part 126 is an elongate part having a vertical wall 132, an angular mating surface 136 and a downwardly extending lip 138. The vertical wall 132 is located to align abuttingly with the joist 40 assisting locating the hanger second part 136. The mating surface 136 is located to retainingly mate with the upturned lip 128 of the hanger first part 122 while cooperating with the downturned lip 140 of the hanger second part 126 to secure the hanger second part 126 adjacent the hanger first part 122.

The pan 124 is an elongate rectangular sheet of a suitable material as described above. The pan 124 has ridges 142 and valleys 144. The pan 124 extends longitudinally between two joists 40 and has a width suitable to span the distance therebetween. The pan 124 may not separately attached to either of the hanger parts 122, 126, but, rather is located between the hanger first part 122 and the hanger second part 126 and deformed to be secured therein by installation of the hanger second part 126.

The pan 124 may further be adjusted to a correct width for fitment between irregularly spaced joists or non-parallel 40 by scoring and breaking as previously describe and by fine tuning as previously described.

When the hanger parts are attached using discrete fasteners 130, may be selectively installed to attache only the hanger first part 122 or may be installed to also pass through and attach the hanger second part also. In some embodiments, the discrete fasteners 130 may also pass through and attach the pan 14, 54, 124 directly to the joist. It is preferred, however that the discrete fasteners 130 do not attach either the hanger second parts 56, 126 or the pan 14, 54, 124 so that the pan 14, 54, 124 may be removed for cleaning or other maintenance.

Figure 13:
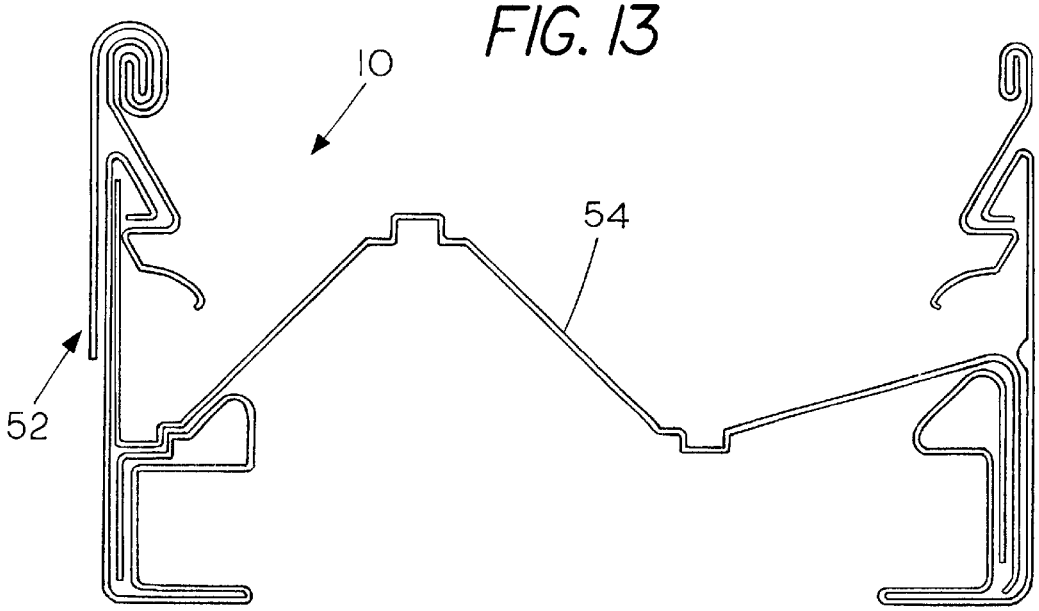
FIG. 13 is a cross sectional view showing one variant of the improved preferred embodiment of the invention of the pan and hangers assembled for use.

FIG. 13 shows another alternate embodiment of the space encloser 10 using the bifurcated hanger 52 and another alternately shaped pan 54. FIGS. 15 through 25 show other alternate embodiments of the hangers 12, 52 for use in varying conditions. In some of the alternate hangers 12, 52 such as shown in FIGS. 18, 19, 22, 23, and 24 the hanger second part 56 is latched into the hanger first part 52, while in the remaining embodiments illustrated, the hanger second part 56 is secured to the hanger first part 52 by friction.

Although the present invention has been described with reference to preferred embodiments, workers skilled in the art will recognize changes may be made in form and detail without departing from the spirit and scope of the invention.

It is hereby claimed:

1. A space enclosure comprising:

a. a pair of sets of hangers, each of the hangers having an inside and an outside, the outside having a means for attachment to a respective joist formed thereon, the inside having a first means for securing formed thereon, the first means for securing further having a recurved open volute and a deformable tail formed thereon defining a closed retainment means thereon, the volute having a shape selected from the group consisting of the capital letters "C," "P," and "R";

b. an elongate pan having a length and a width, and at least one primary ridge extending the length of said pan, the at least one ridge dividing the pan and longitudinally stiffening the pan, while forming a plurality of longitudinal troughs, the at least one ridge further dividing liquids, substantially evenly among the plurality of troughs; the pan further having edges along the periphery of the length, the edges having a second means for securing formed thereon, the means for securing having a closed volute shaped for selective alignment with the open volute of the first means for securing and retaining the pan therein; whereby the collected liquids are divided among the plurality of troughs for flow to the selected end for collection and removal therefrom.

2. The enclosure as described in claim 1 wherein the second means for securing is separable from the pan.

3. The enclosure as described in claim 1 wherein the second means for securing further comprises a means for stabilizing the pan from wind movement.

4. The enclosure as described in claim 3 wherein the means for stabilization comprises a pocket formed in the second securement means for receiving a transverse bar, the transverse bar further being attached to and between a pair of joists.

5. The enclosure as described in claim 1 wherein the pan further comprises at least one secondary ridge and a bead defined between said primary ridge and said secondary ridge, the bead forming a scoring area for scoring and breaking the pan for reducing the width of the pan.

6. The enclosure as described in claim 5 wherein the pan further includes a means for fine width adjustment.

7. The enclosure as described in claim 6 wherein the means for fine width adjustment comprises at least one finger port for squeezingly making fine adjustments to the width of said pan.

8. The enclosure as described in claim 2 wherein the second securement means comprises a first pocket for retaining one of the edges of the pan.

9. The enclosure as described in claim 8 wherein the pan further comprises peripheral longitudinal edges and a longitudinal shoulder adjacent each of said pan edges, and the second securement means further comprises a second pocket for receiving the pan shoulder.

10. The enclosure as described in claim 1 further comprising a bonnet located above each of said hangers and sealingly attached to a respective joist, the bonnet further having a lip extending downwardly and outwardly from the joist for directing the liquids from the joist.

11. The enclosure as described in claim 10 wherein the bonnet is formed integrally with the hanger.

12. A space enclosure comprising:

a. a set of first hangers, each of said hangers having an inner edge and an outer edge, the outer edges of a plurality of said hangers attached longitudinally to parallel supports in a sloping manner, the inner edges of said hangers having a matable first means for securing formed thereon, the mating first securing means extending upwardly and inwardly thereat;

b. an elongate rectangular pan, having a length and a width, and at least one ridge extending along the length of said pan, the width of the pan corresponding to a spacing between the parallel supports, c. a set of second hangers, wherein each of said hangers having an inner edge and an outer edge, the outer edges of a plurality of said hangers abutting on the parallel supports, the inner edges having a matable second securing means for securing formed thereon, the second means extending downwardly and inwardly thereat, whereby the pan is placed along the first securing means and the second securing means is aligned therealong and urged into a mating position to secure the pan and second set of hangers secured to the first set of hangers.

13. The enclosure as described in claim 12 wherein the first securement means comprises an outwardly extending key and the second securement means comprises an inwardly extending keyhole for accepting the deformed pan and the key of the first securement means.

14. The enclosure as described in claim 12 wherein the first set of hangers are attached to the parallel supports using discrete fasteners.

15. The enclosure as described in claim 12 wherein the first and second sets of hangers are attached to the parallel supports using discrete fasteners.

16. The enclosure as described in claim 12 wherein the first set of hangers comprises a single elongate unitary hanger.

17. The enclosure as described in claim 12 wherein the second set of hangers comprises a single elongate unitary hanger.

* * * * *

UNITED STATES PATENT AND TRADEMARK OFFICE

CERTIFICATE OF CORRECTION

PATENT NO. : 6,421,967 B1
DATED : July 23, 2002
INVENTOR(S) : John D. Walker

It is certified that error appears in the above-identified patent and that said Letters Patent is hereby corrected as shown below:

Title page,
Item [76], Inventor reads "John D. Wlaker." the correct spelling should be -- John D. Walker --.

Signed and Sealed this

Twenty-first Day of January, 2003

JAMES E. ROGAN
*Director of the United States Patent and Trademark Office*